US007815063B2

(12) United States Patent
Shingle

(10) Patent No.: US 7,815,063 B2
(45) Date of Patent: Oct. 19, 2010

(54) CLOSURE AND PACKAGE WITH USER-SELECTABLE CHILD-RESISTANT AND NON-CHILD-RESISTANT MODES OF OPERATION

(75) Inventor: John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 884 days.

(21) Appl. No.: 11/655,394

(22) Filed: Jan. 19, 2007

(65) Prior Publication Data

US 2008/0173609 A1 Jul. 24, 2008

(51) Int. Cl.

| | |
|---|---|
| ***B65D 55/02*** | (2006.01) |
| ***B65D 55/00*** | (2006.01) |
| ***B65D 51/00*** | (2006.01) |
| ***G09F 3/00*** | (2006.01) |

(52) U.S. Cl. ..... 215/222; 215/201; 215/218; 215/230; 40/311

(58) Field of Classification Search ..... 215/230, 215/211, 201, 216–218, 222, 223, 354; 220/293, 220/298, 300; 40/311; 206/459.5
See application file for complete search history.

(56) References Cited

U.S. PATENT DOCUMENTS 3,698,584 A * 10/1972 Miller ..... 215/216
3,830,391 A 8/1974 Uhlig
3,944,101 A 3/1976 Landon et al.
3,984,021 A 10/1976 Uhlig
4,479,585 A 10/1984 Sandhaus (Continued)

FOREIGN PATENT DOCUMENTS

FR 2494670 5/1982

(Continued)

OTHER PUBLICATIONS

Notification of Transmittal of the International Search Report for PCT/US2008/000345, Form PCT/ISA/220, mailed May 21, 2008.

(Continued)

*Primary Examiner*—Robin Hylton
(74) *Attorney, Agent, or Firm*—Reising Ethington PC

(57) ABSTRACT

A child-resistant closure includes a one-piece plastic shell having a base wall with a peripheral edge, an annular skirt, and a bistable snap-action toggle connection between the peripheral edge of the base wall and the skirt such that the skirt is adapted to be moved between two stable positions with respect to the base wall. At least one lug is disposed on the skirt or the base wall for engagement with cooperating structure in a child-resistant mode of operation in a first position of the skirt with respect to the base wall. The skirt is movable with respect to the base wall between the first position and a second positions for selecting between the child-resistant and the non-child-resistant modes of operation of the closure. The bistable snap-action connection preferably includes a continuous annular wall connecting the peripheral edge of the base wall to the skirt, with the annular wall being outwardly conical in one position of the skirt and inwardly conical in the other position of the skirt with respect to the base wall.

6 Claims, 6 Drawing Sheets

U.S. PATENT DOCUMENTS

| | | | | |
|---|---|---|---|---|
| 4,535,905 | A | 8/1985 | Sandhaus | |
| 4,854,459 | A | 8/1989 | DeJonge | |
| 4,998,632 | A | 3/1991 | Morris, Sr. | |
| 5,397,009 | A * | 3/1995 | Salmon et al. | 215/252 |
| 5,899,348 | A | 5/1999 | Konefal et al. | |
| 6,039,195 | A | 3/2000 | Konefal et al. | |
| 6,327,770 | B1 | 12/2001 | Konefal et al. | |
| 2005/0103741 | A1 | 5/2005 | Shingle | |
| 2005/0109726 | A1 | 5/2005 | Alley | |
| 2005/0150857 | A1 | 7/2005 | Brozell et al. | |
| 2006/0070970 | A1 | 4/2006 | Shingle | |
| 2006/0108313 | A1 | 5/2006 | Brozell et al. | |

FOREIGN PATENT DOCUMENTS

| | | |
|---|---|---|
| GB | 2305656 A | 4/1997 |
| WO | 9928205 | 6/1999 |

OTHER PUBLICATIONS

International Search Report for PCT/US2008/000345, Form PCT/ISA/210, mailed May 21, 2008.
Written Opinion of the International Searching Authority for PCT/US2008/000345, Form PCT/ISA/237, mailed May 21, 2008.

* cited by examiner

CLOSURE AND PACKAGE WITH USER-SELECTABLE CHILD-RESISTANT AND NON-CHILD-RESISTANT MODES OF OPERATION

The present disclosure relates to a package having user-selectable child-resistant and non-child-resistant modes of operation, and to a closure for such a package.

BACKGROUND AND SUMMARY OF THE DISCLOSURE

Several types of child-resistant closures and packages have been proposed to resist or impede opening by a child. These packages may contain medications, household products and the like that can be harmful if not properly used. However, child-resistant packages also can impede opening by adults having reduced manual dexterity. Child-resistant closures and packages have been proposed that can be inverted or converted to a non-child-resistant mode of operation. However, such closures and packages are complex and/or expensive and/or difficult for a user to convert between child-resistant and non-child-resistant modes of operation. A general object of the present disclosure is to address one or more of these deficiencies in the prior art.

The present disclosure embodies a number of aspects that can be implemented separately from or in combination with each other.

A child-resistant closure, in accordance with one aspect of the present disclosure, includes a one-piece plastic shell having a base wall with a peripheral edge, an annular skirt, and a bistable snap-action toggle connection between the peripheral edge of the base wall and the skirt such that the skirt is adapted to be moved between two stable positions with respect to the base wall. At least one lug is disposed on the skirt or the base wall for engagement with cooperating structure in a child-resistant mode of operation in a first position of the skirt with respect to the base wall. The skirt is movable with respect to the base wall between the first position and a second position for selecting between child-resistant and non-child-resistant modes of operation of the closure. The bistable snap-action connection preferably includes a continuous annular wall connecting the peripheral edge of the base wall to the skirt, with the annular wall being outwardly conical in one position of the skirt and inwardly conical in the other position of the skirt with respect to the base wall. The annular wall preferably includes annular regions of reduced thickness connecting the annular wall to the skirt and the base wall. The closure preferably includes indicia that are covered by the skirt in one position of the skirt and uncovered by the skirt in the other position of the skirt with respect to the base wall for indicating to a user whether the closure is in the child-resistant or the non-child-resistant mode of operation.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
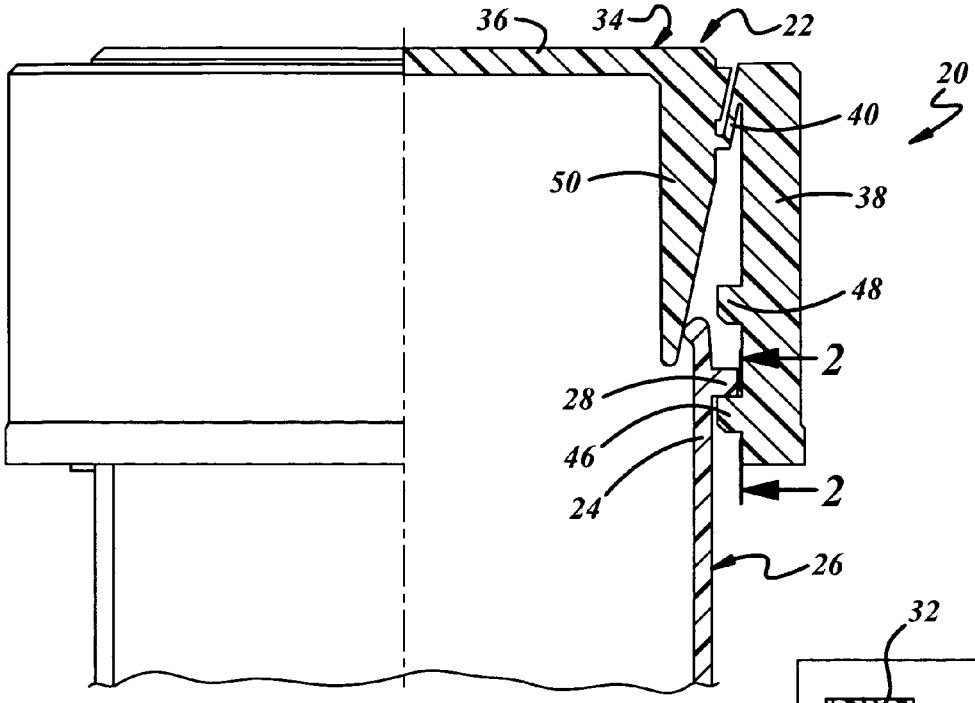
FIG. 1 is a fragmentary partially sectioned elevational view of a package in accordance with a first exemplary embodiment of the present disclosure in a child-resistant mode of operation.

FIGS. 1-4 illustrate a package 20 in accordance with a first exemplary embodiment of the present disclosure as including a closure 22 applied to the open end or finish 24 of a container 26. Container 26 has a circumferential array of angularly spaced external bayonet projections 28 around the finish of the container adjacent to the container mouth. Each projection 28 includes an underside with a cam surface 30 and a notch 32. Bayonet-type push-and-turn child-resistant packages with containers of this type are illustrated, for example, in U.S. Pat. Nos. 4,057,159, 4,059,198 and 4,485,932.

Closure 22 includes a one-piece plastic shell 34 having a base wall 36 and an annular peripheral skirt 38. A bistable snap-action toggle connection 40 connects the peripheral edge of base wall 36 to the adjacent edge of skirt 38. Thus, skirt 38 can be moved with respect to base wall 36 (or base wall 36 can be moved with respect to skirt 38) between two stable positions, a first or child-resistant retracted position illustrated in FIG. 1 and a second or non-child-resistant extended position illustrated in FIGS. 3 and 6. Indicia 42 (FIG. 3) preferably are provided at a position adjacent to base wall 36 so as to be covered by skirt 38 in one of the two positions of skirt 38 with respect to base wall 36, and to advise a user whether the closure is configured for child-resistant or non-child-resistant operation. In the embodiment of FIGS. 1-7, indicia 42 is uncovered by skirt 38 in the non-child-resistant configuration of the closure, and can say "CAUTION" or "NOT CHILD RESISTANT" for example.

Figure 2:
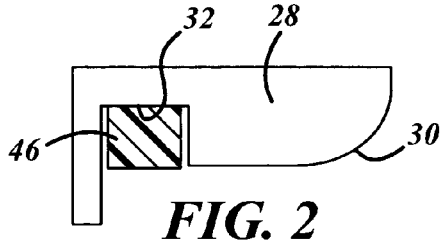
FIG. 2 is a fragmentary sectional view taken substantially along the line 2-2 in FIG. 1.
Figure 3:
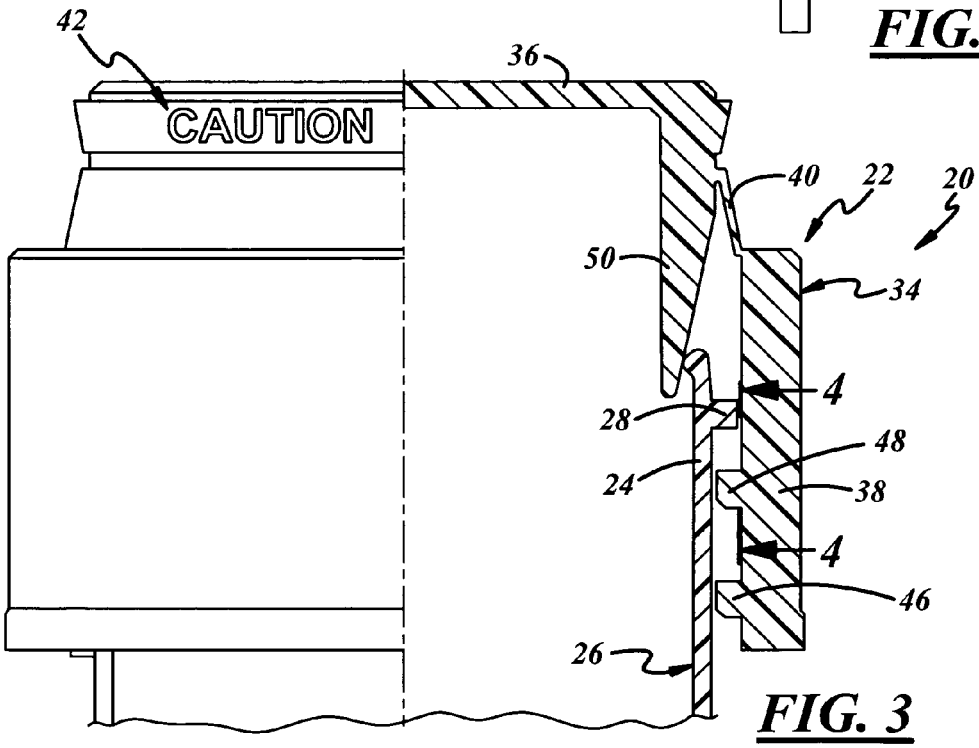
FIG. 3 is a fragmentary partially sectioned elevational view of the package in FIG. 1 in a non-child-resistant mode of operation.
Figure 4:
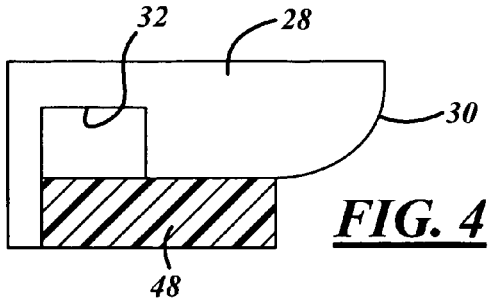
FIG. 4 is a fragmentary sectional view taken substantially along the line 4-4 in FIG. 3.
Figure 5:
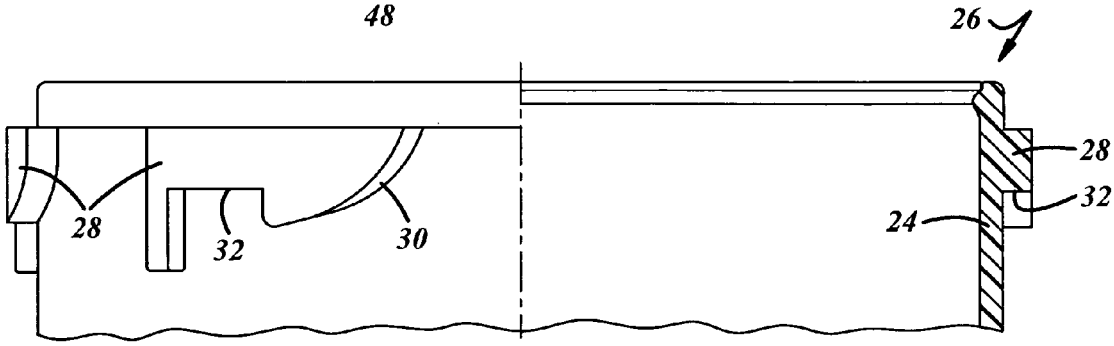
FIG. 5 is a fragmentary partially sectioned elevational view of the container in the package of FIGS. 1-4.
Figure 6:
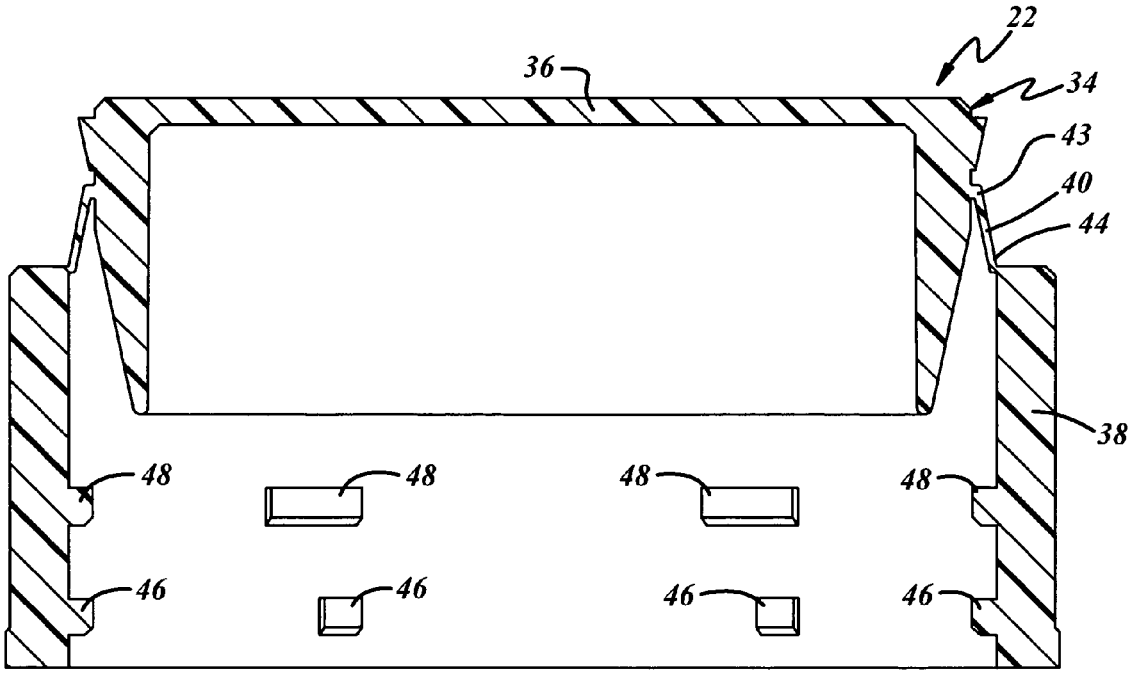
FIG. 6 is a sectional view of the closure in the package of FIGS. 1-4.
Figure 7:
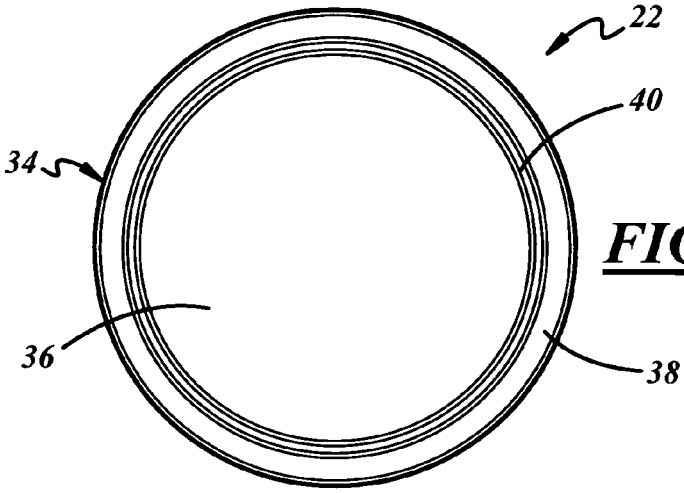
FIG. 7 is a top plan view of the closure in FIG. 6.
Figure 8:
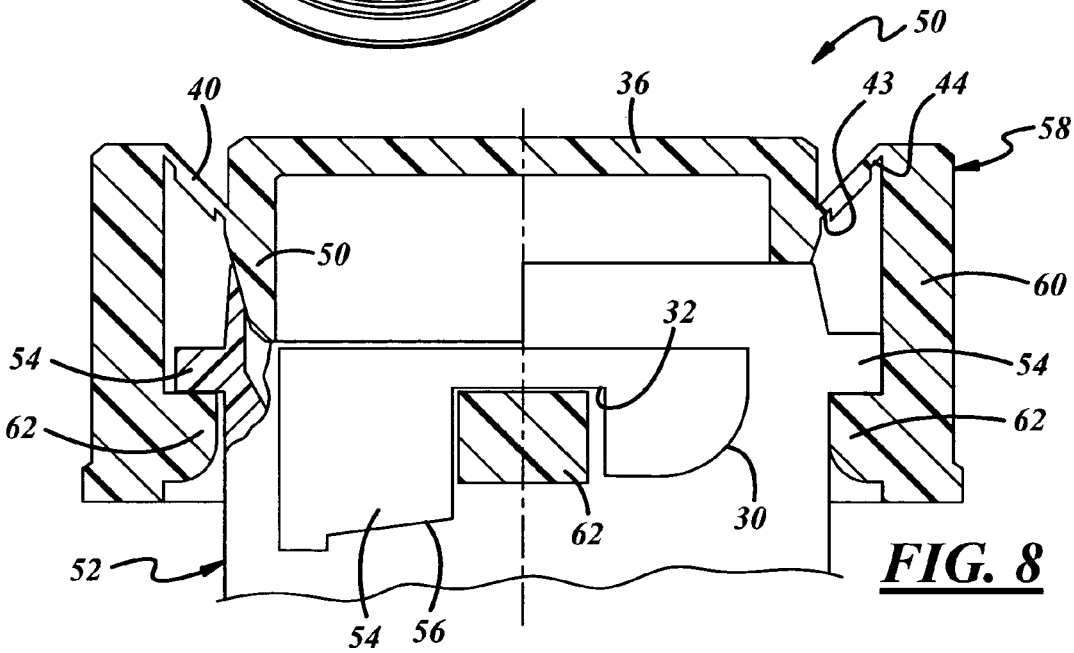
FIG. 8 is a fragmentary partially sectioned elevational view of a package in accordance with a second exemplary embodiment of the present disclosure in a child-resistant mode of operation.
Figure 9:
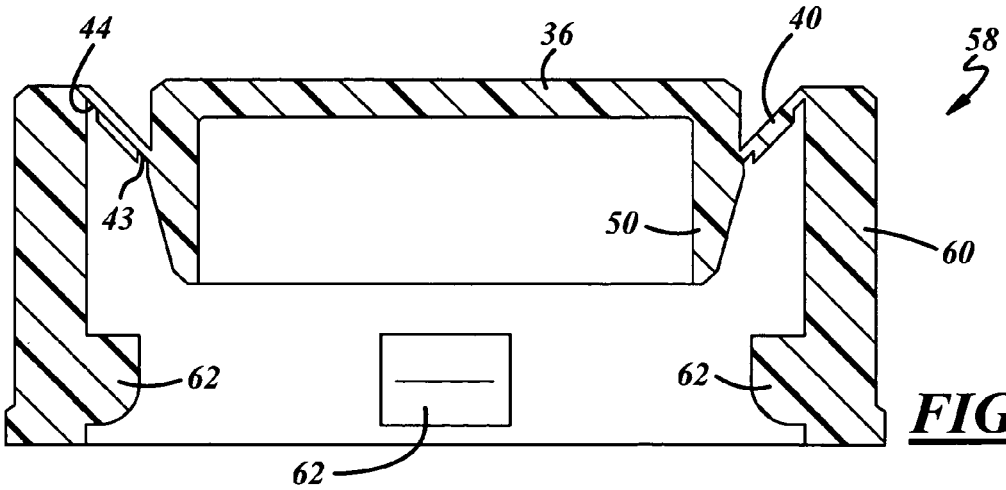
FIG. 9 is a sectional view of the closure in the package of FIG. 8.
Figure 10:
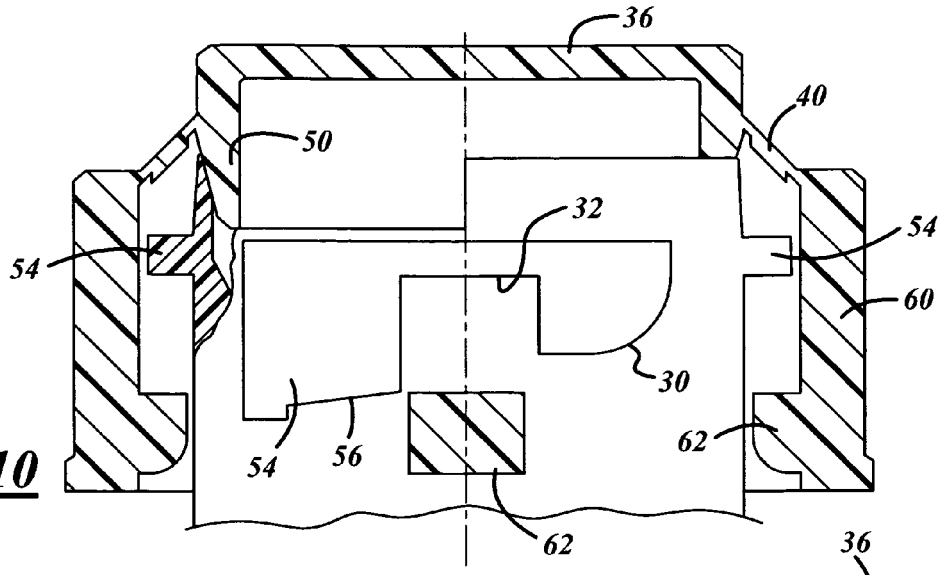
FIG. 10 is a fragmentary partially sectioned elevational view of the package in FIG. 8 in a non-child-resistant mode of operation.

Toggle connection 40 preferably is in the form of a continuous annular wall extending between the peripheral edge of base wall 36 and the adjacent edge of skirt 38. Toggle connection annular wall 40 preferably has regions 43,44 of reduced thickness at the connection to base wall 36 and skirt 38 to facilitate manual (or automated) snap-action inversion of connection wall 40 between the outwardly conical extended non-child-resistant position of FIGS. 3 and 6 and the inwardly conical retracted child-resistant position of FIG. 1. A first angularly spaced array of internal lugs 46 are disposed on skirt 38 for receipt in projection notches 32 in the child-resistant mode of operation (FIGS. 1 and 2). A second angularly spaced array of internal lugs 48 are provided on skirt 38 for engagement with projections 28 in the non-child-resistant mode of operation (FIGS. 3 and 4). The arrays of lugs 46,48 are axially spaced from each other on the inner surface of skirt 38, and each lug 46 preferably is axially aligned with a corresponding lug 48 as best seen in FIG. 6.

In the child-resistant mode of operation with base wall 36, skirt 38 and toggle connection 40 configured as illustrated in FIGS. 1 and 2, internal lugs 46 are positioned to engage cam surfaces 30 as closure 22 is applied to container finish 24 to pull the closure onto the container as lugs 46 ride over cam surface 30 until lugs 46 snap into notches 32 on projections 28. Lugs 46 are held in notches 32 by a spring force developed between closure 22 and container 26. This spring force can be developed by any suitable means. In the embodiment of FIGS. 1-7, the spring force is developed by engagement between an inner annular closure wall 50, which extends from base wall 36 within skirt 38, and the inside diameter of the container mouth. The spring force is developed by inward flexure of wall 50 and/or outward flexure of the container mouth. The spring force alternatively could be developed by one or more separate spring and/or spring seal elements carried by closure 22 as illustrated in the above-noted patents for example, and/or by spring elements carried by container 26. To remove the closure, the closure is pressed over container finish 24 until lugs 46 clear notches 32, at which point the closure can be rotated counterclockwise and removed from the container.

In the non-child-resistant mode of operation illustrated in FIGS. 3 and 4, with skirt 38 extended from base wall 36, internal lugs 48 on skirt 38 (rather than lugs 46) are positioned for engagement with projections 28 as the closure is applied to the container. The lugs again engage cam surfaces 30 and pull the closure onto the container finish against the spring force. However, lugs 48 are too long in the circumferential direction to snap into notches 32, as best seen in FIG. 4, so that lugs 48 merely ride on the undersides of projections 28. In this non-child-resistant mode of operation, closure 22 can be removed from container 26 by merely rotating the closure in the counterclockwise or unthreading direction. The spring force developed between annular wall 50 and the container finish serves frictionally to hold the closure on the container in the non-child-resistant mode.

Figure 11:
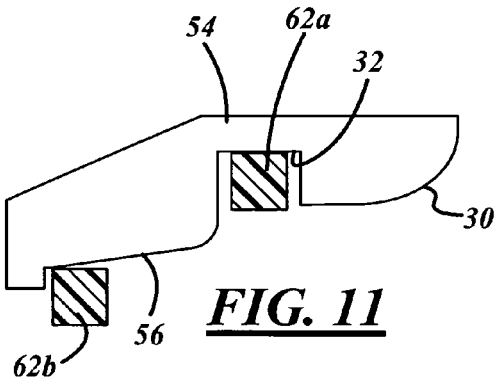
FIG. 11 is a schematic diagram that illustrates child-resistant and non-child-resistant operation of the package of FIGS. 8-10.

FIGS. 8-11 illustrate a second exemplary embodiment of the disclosure, again employing bayonet-style push-and-turn child-resistance mechanisms. In FIGS. 8-11 (and in FIGS. 12-17), reference numerals that are identical to those used in FIGS. 1-7 indicate correspondingly identical or related components. In the package 50 of FIGS. 8-11, container 52 has external projections 54 with undersides having a first leading cam surface 30, a second trailing cam surface 56 spaced angularly and axially from cam surface 30, and a notch 32 disposed between cam surfaces 30,56. Closure 58 in package 50 includes a one-piece shell having a base wall 36 connected to an annular skirt 60 by bistable snap-action toggle connection wall 40. Skirt 60 has a plurality of angularly spaced internal lugs 62. In the child-resistant configuration of closure 58 illustrated in FIGS. 8 and 9, with skirt 60 in a retracted position with respect to base wall 36, lugs 62 are positioned to engage cam surfaces 30 of projections 54 as the closure is applied to container 52 to pull the closure downwardly against the spring force developed by annular wall 50 until lugs 62 snap into notches 32. In the non-child-resistant extended position of skirt 60 with respect to base wall 36 illustrated in FIG. 10, internal lugs 62 are positioned to miss cam surfaces 30 and notches 32, but to engage cam surfaces 56 so that lugs 62 are frictionally held on cam surfaces 56 on the undersides of lugs 54 by the spring force developed by wall 50. FIG. 11 illustrates the child-resistant mode of operation where lug 62*a* is received in notch 32, and the non-child-resistant mode of operation where lug 62*b* is slidably engaged with cam surface 56.

Figure 12:
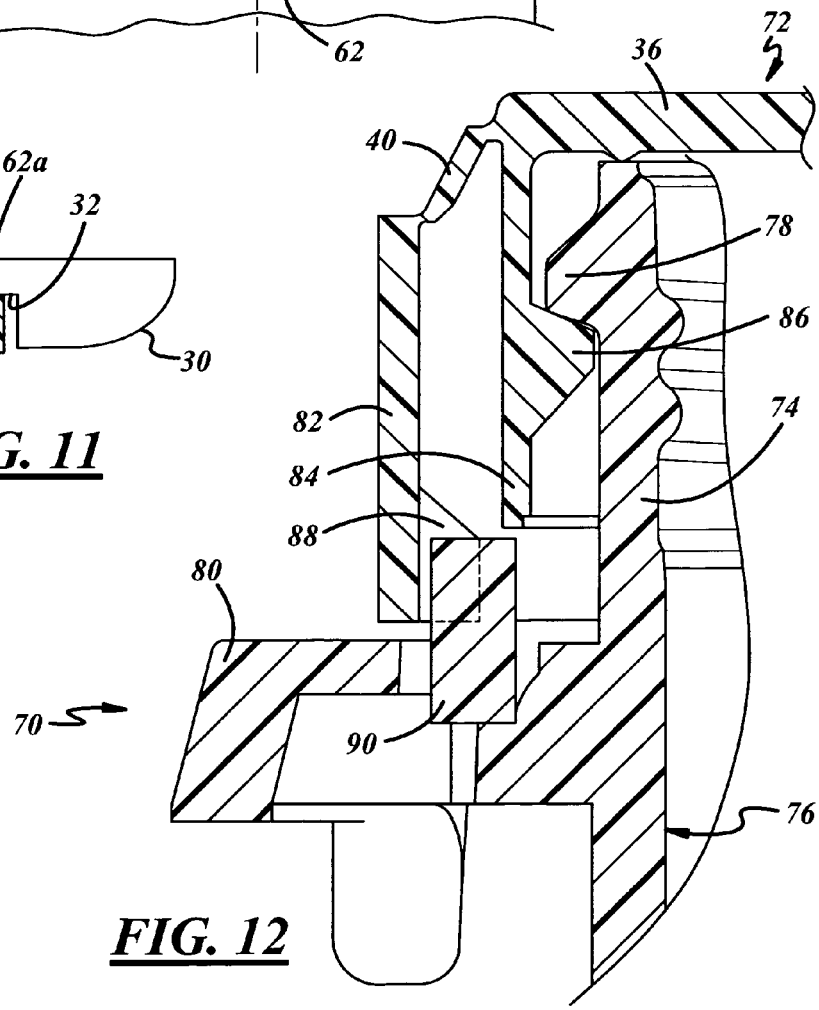
FIG. 12 is a fragmentary sectional view of a package in accordance with a third exemplary embodiment of the present disclosure in a child-resistant mode of operation.
Figure 13:
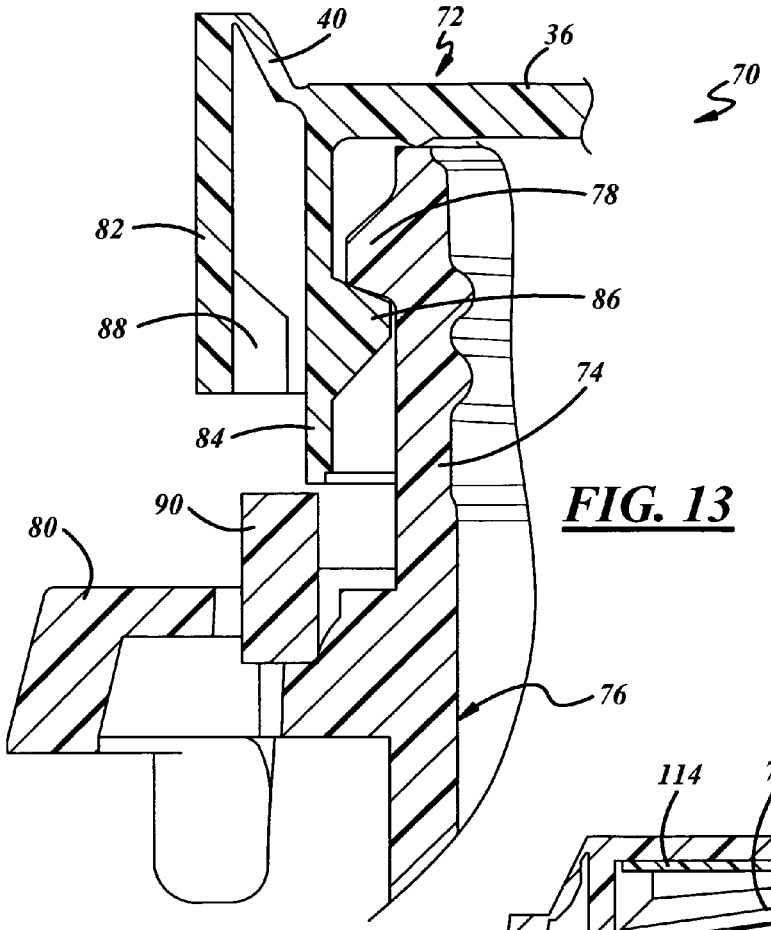
FIG. 13 is a fragmentary sectional view of the package of FIG. 12 in a non-child-resistant mode of operation.

FIGS. 12 and 13 illustrate a package 70, in a third exemplary embodiment of the present disclosure, in child-resistant (FIG. 12) and non-child-resistant (FIG. 13) modes of operation. Package 70 is generally of the type illustrated in U.S. Pat. Nos. 5,899,348, 6,039,195 and 6,327,770, comprising a closure 72 threaded onto the neck finish 74 of a container 76. Container neck finish 76 has at least one external thread segment 78 and an axially deflectable release element 80 disposed beneath thread segment 78. Closure 72 includes a one-piece plastic shell having base wall 36 and an annular skirt 82 connected to the periphery of base wall 36 by bistable snap-action toggle connection annular wall 40. An inner annular wall 84 extends from base wall 36 within skirt 82 and has at least one internal thread segment 86 for engagement with external thread segment 78 to secure closure 72 to container 76. (The term "thread segment" is employed in its usual broad sense to include segmented and continuous threads, and to include single and multiple threads.) Skirt 82 includes at least one internal lug 88 for selective engagement with a locking lug 90 on release element 80 in the child-resistant mode of operation (FIG. 12), so that release element 80 must be depressed until locking lug 90 clears skirt lug 88 so that closure 72 can be unthreaded. However, in the non-child-resistant mode of operation with skirt 82 retracted as shown in FIG. 13, internal skirt lug 80 is well clear of locking lug 90 on release element 80 so that closure 72 can be simply unthreaded from the container finish.

Figure 14:
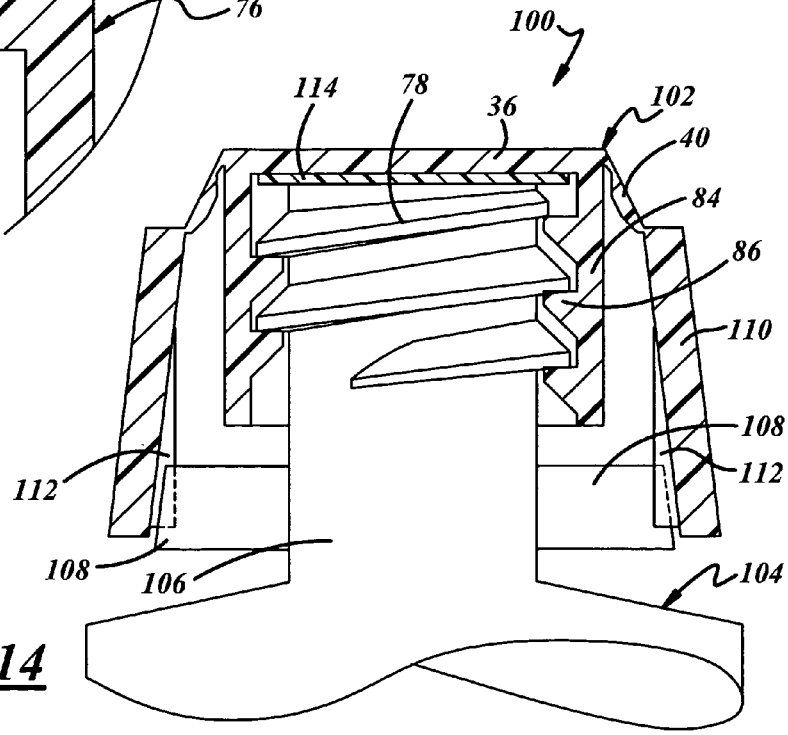
FIG. 14 is a fragmentary sectional view of a package in accordance with a fourth exemplary embodiment of the present disclosure in a child-resistant mode of operation.
Figure 15:
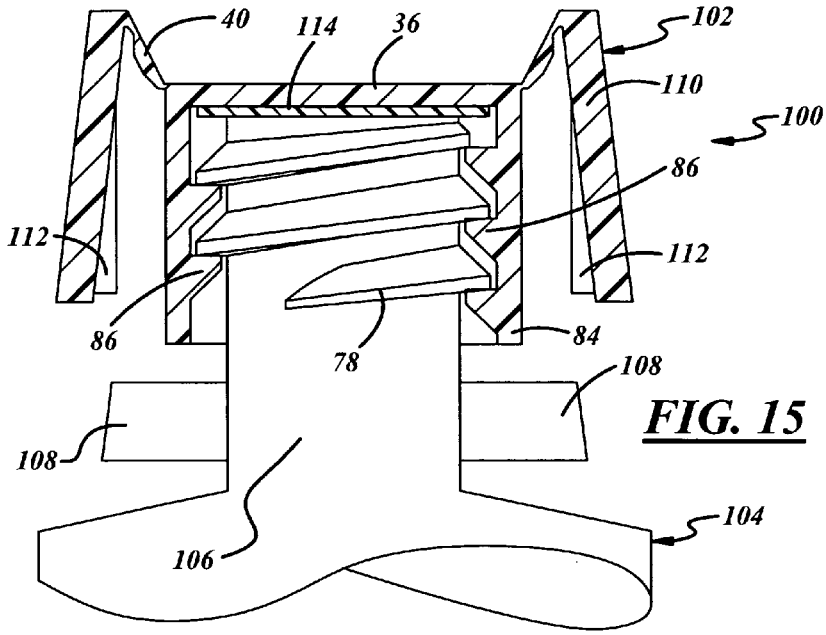
FIG. 15 is a fragmentary sectional view of the package in FIG. 14 in a non-child-resistant mode of operation.

FIGS. 14 and 15 illustrate a package 100 in accordance with a fourth exemplary embodiment of the present disclosure, in which the closure 102 is selectively configurable in a squeeze-and-turn child-resistant mode of operation (FIG. 14) or a non-child-resistant mode of operation (FIG. 15). Container 104 has a neck finish 106 with at least one external thread segment 78 and at least one external lug 108 disposed beneath thread segments 78. There preferably are a pair of diametrically opposed external lugs 108. Closure 102 includes a one-piece plastic shell having base wall 36, inner wall 84 with at least one internal thread segment 86 for engagement with external thread segment 78, toggle connection wall 40 and an external flexible resilient annular skirt 110 with at least one internal lug 112. Preferably there are diametrically opposed internal lugs 112 in correspondence with diametrically opposed external lugs 108. With skirt 110 extended as shown in FIG. 14 in a child-resistant mode of operation, skirt 110 must be squeezed and ovalized until internal lugs 112 are clear of external lugs 108, at which point closure 102 can be unthreaded from container neck finish 106. However, with closure 102 configured in the non-child-resistant mode illustrated in FIG. 15, with skirt 110 retracted with respect to base wall 36, internal lugs 112 are well clear of external lugs 108 so that closure 102 can be simply unthreaded from container neck finish 106. In the embodiment of FIGS. 14 and 15, closure 102 includes a liner 114 disposed within the closure shell. Liner 114 can be adhered to the undersurface of the base wall 36 or can comprise a separate disk captured by thread segment(s) 86.

Figure 16:
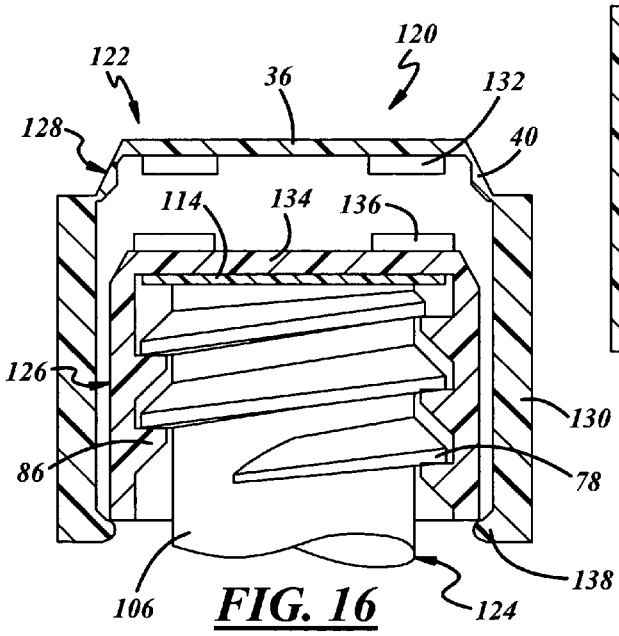
FIG. 16 is a fragmentary sectional view of a package in accordance with a fifth exemplary embodiment of the present disclosure in a child-resistant mode of operation.
Figure 17:
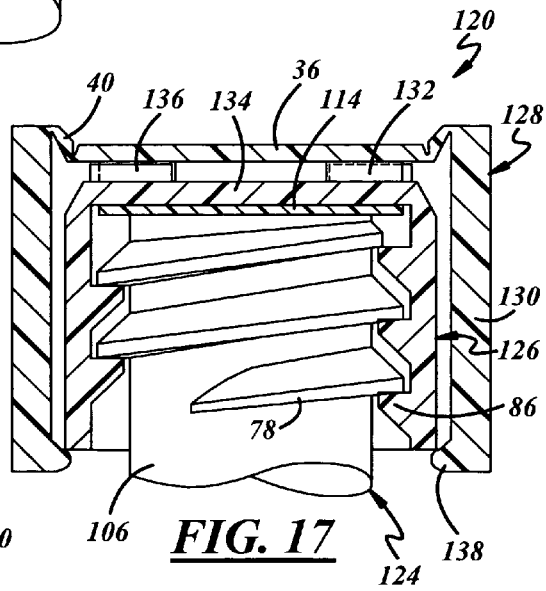
FIG. 17 is a fragmentary sectional view of the package in FIG. 16 in a non-child-resistant mode of operation.

FIGS. 16 and 17 illustrate a package 120 in accordance with a fifth exemplary embodiment of the present disclosure in child-resistant (FIG. 16) and non-child-resistant (FIG. 17) modes of operation. Package 120 includes a closure 122 applied to the neck finish 106 of a container 124. Closure 122 is a two-element closure comprising an inner shell 126 and an outer shell 128. Closures and packages of this general type are illustrated, for example, in U.S. Pat. No. 4,997,096 and US patent document 2006/0108313. Outer shell 128 includes an annular skirt 130 connected to a base wall 36 by bistable snap-action toggle connection wall 40. Axially downwardly facing internal lugs 132 are disposed on the undersurface of base wall 36. Inner shell 126 includes at least one internal thread segment 86 for engagement with the at least one external thread segment 78 on container neck finish 106, and a base wall 134 with at least one axially upwardly facing external lug 136 for engagement with internal lugs 132 to rotate inner shell 26. A circumferential bead 138 on skirt 130 captures inner shell 126 within outer shell 128. With skirt 130 positioned in the extended or child-resistant position illustrated in FIG. 16, axial force must be applied to outer shell 28 to maintain engagement between opposed arrays of lugs 132,136 so that rotation of outer shell 128 will be imparted to inner shell 126 to unthread the closure from the container neck finish. Lugs 132 and/or 136 have cam surfaces that allow the lugs simply to ride over each other in the absence of such downward force. However, with skirt 130 positioned in the retracted or non-child-resistant position illustrated in FIG. 17, inner shell 126 is captured firmly between bead 138 and base wall 36 of outer shell 128 so that arrays of lugs 132,136 are held in continuous engagement and simple turning of closure 122 will unthread the closure from the container neck finish.

There thus have been disclosed a child-resistant closure and a child-resistant package having user-selectable child-resistant and non-child-resistant modes of operation, which fully satisfy all of the objects and aims previously set forth. The closure of the present disclosure includes a skirt that is manually movable by a user (or automatically by automated filling equipment) between stable extended and retracted portions with respect to a base wall. In the embodiments of FIGS. 1-7 and 8-11, the extended portion of the skirt is the child-resistant position and the retracted position is the non-child-resistant position. In the embodiments of FIGS. 12-13, 14-15 and 16-17, the extended skirt position is the child-resistant position and the retracted position is the non-child-resistant position. The disclosure has been presented in conjunction with several exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A child-resistant closure that includes:

a one-piece plastic shell having a base wall with a peripheral edge, an annular skirt, and a bistable snap-action toggle connection between said peripheral edge of said base wall and said skirt such that said skirt is adapted to be moved between two stable positions with respect to said base wall, and at least one lug on said skirt or said base wall for engagement with cooperating structure in a child-resistant mode of operation in a first position of said skirt with respect to said base wall, said skirt being movable with respect to said base wall between said first position and a second position for selecting between said child-resistant and said non-child-resistant modes of operation of same closure including indicia on said shell that are covered by said skirt in one of said first and second positions, and uncovered by said skirt in the other of said first and second positions, for indicating to a user whether said closure is in said child-resistant or said non-child-resistant mode of operation.

2. A package with user-selectable child-resistant and non-child-resistant modes of operation, which includes:

a container having an open end and an external array of bayonet projections extending around said open end, each of said bayonet projections having an underside with at least one cam surface and a notch, and a closure including a one-piece plastic shell having a base wall with a peripheral edge, an annular skirt, a bistable snap-action toggle connection between said peripheral edge of said base wall and said skirt such that said skirt is manually movable between two stable positions with respect to said base wall, at least one circumferential array of internal lugs on said skirt adapted to engage said undersides of said projections, and a spring element to hold said lugs in engagement with said undersides of said projections, said lugs being adapted to be received in said notches in a child-resistant mode of operation of said package with said skirt in a first position with respect to said base wall, and being adapted to engage said cam surfaces but not be received in said notches in a non-child-resistant mode of operation of said package with said skirt in a second position with respect to said base wall, wherein said at least one circumferential array of internal lugs includes two circumferential arrays of angularly spaced internal lugs on said skirt, said arrays being axially spaced from each other such that one of said arrays is positioned to engage said external projections in one position of said skirt with respect to said base wall and the other of said arrays is positioned to engage said external projections in the other position of said skirt with respect to said base wall.

3. The package set forth in claim 1 wherein said bistable snap-action connection includes a continuous annular wall connecting said peripheral edge of said base wall to said skirt, said annular wall being outwardly conical in one position of said skirt and inwardly conical in the other position of said skirt with respect to said base wall.

4. The package set forth in claim 3 wherein said annular wall includes annular regions of reduced thickness connecting said annular wall to said skirt and said base wall.

5. The package set forth in claim 1 including indicia on said shell that are covered by said skirt in one of said first and second positions of said skirt with respect to said base wall, and uncovered by said skirt in the other of said first and second positions of said skirt with respect to said base wall, for indicating to a user whether said package is in a child-resistant or a non-child-resistant mode of operation.

6. The package set forth in claim 2 wherein lugs of one of said arrays are circumferentially longer than lugs of the other of said arrays, lugs of said other array being sized for receipt in said notches while lugs of said one array are sized for engagement with said cam surfaces but not for receipt in said notches.

* * * * *